United States Patent [19]

Otani

[11] 4,123,748

[45] Oct. 31, 1978

[54] BURGLAR ALARMS UTILIZING ULTRASONIC WAVES

[75] Inventor: Hiroaki Otani, Kawasaki, Japan

[73] Assignee: Nippon Prosensor Co., Ltd., Kawasaki, Japan

[21] Appl. No.: 748,682

[22] Filed: Dec. 8, 1976

[51] Int. Cl.[2] ..... G08B 13/16

[52] U.S. Cl. ..... 340/558; 340/310 A; 340/538; 343/5 PD

[58] Field of Search ..... 340/258 B, 258 A, 416, 340/310 A, 310 R; 343/5 PD, 7.7

[56] References Cited

U.S. PATENT DOCUMENTS

| | | | |
|---|---|---|---|
| 3,680,074 | 7/1972 | Lieser | 340/258 A |
| 3,781,859 | 12/1973 | Hermans | 343/5 PD |
| 3,986,182 | 10/1976 | Hackett | 340/258 A |

*Primary Examiner*—Glen R. Swann, III

*Attorney, Agent, or Firm*—Blanchard, Flynn, Thiel, Boutell & Tanis

[57] ABSTRACT

Burglar alarms utilizing ultrasonic waves in which ultrasonic waves transmitted from a wave transmitting oscillator are reflected by such objects as doors, windows, floors, walls, etc. and such reflected ultrasonic waves will be received by a wave receiving oscillator. Then, when those received ultrasonic waves are disturbed by an illegal intruder, a change in signal will be detected and become an input signal for actuating alarms. Remote units each consisting of an amplifier, wave transmitting oscillator, wave receiving oscillator, etc. will be installed directed at doors, windows, etc., and such remote units are connected to a main unit consisting of a high-frequency voltage generator installed in an watching room or a control room. In this case, the generation of beating between the main unit and each remote unit when sending signals from the main unit in each power source line is prevented by means of filters as is the generation of beating between the remote units is prevented, is simplified, and the intrusion of electrical noise is prevented by means of an impedance transducer.

6 Claims, 5 Drawing Figures

BURGLAR ALARMS UTILIZING ULTRASONIC WAVES

SUMMARY OF THE INVENTION

The present invention, in burglar alarms utilizing ultrasonic waves, will prevent the generation of beating between the main unit and respective remote units or the generation of beating between remote units and also will transmit oscillating signals in each power source line in multiple.

Known burglar alarms utilizing ultrasonic waves are constructed generally in the following manner. That is, a main unit will generate a high-frequency voltage, and this oscillating signal will then be given to each remote unit consisting of an amplifier, a wave transmitting oscillator and a wave receive oscillator. The ultrasonic wave generated by the wave transmitting oscillator of this remote unit will be emitted toward doors, windows, etc. which are places where an illegal intruder is liable to pass therethrough and the reflected ultrasonic wave will be received by the wave receiving oscillator. Under such circumstances, when the illegal intruder comes into an area radiated with ultrasonic waves, there occurs a disturbance in said reflected wave, its variation will be detected by the wave receiving oscillator, and then the detected variation becomes an input signal to ring the alarm.

In such burglar alarms, when more than 2 remote units are installed close to each other or the main unit and remote units are connected by the same electric power line, beating might occur on account of mutual interference due to a difference in oscillating frequency between the main unit and a remote unit or between a pair of remote units. The main unit and a plurality of remote units will be connected by power source lines and signal transmitting lines. In case, for example, of being for surveillance, the main unit is installed in a watching room or control room, while the small remote units are installed on every door and/or window of each room. For this reason, separate wiring for power source lines and for signal transmitting lines will make wiring work complicated and many wires will be required.

An object of the present invention is to prevent the generation of frequency beating between the main unit and each remote unit or between remote units and to enable wiring with the fewest possible cables. For this purpose, the oscillating signal from the main unit will be transferred by the power source line connecting the main unit to each remote unit. As a result, signal transmitting lines are omitted, wiring work is facilitated and the amount of cable used will become smaller. Further, at output terminals in power source section and the oscillator section of the main unit are inserted respectively, a low-pass filter and a D.C. cutoff filter, and at input terminals in the power source section and the amplifier of each remote unit are inserted respectively a low-pass filter and a D.C. cut-off filter. For this reason, each unit is compulsorily synchronized by the main unit, so there will occur no beating.

Wires connecting the main unit to each remote unit may be very long in length. Thereby, there might be a possibility that electrical noise be mixed in. In an attempt to prevent the intrusion of such noise, an exclusive shield wire perfectly shielded has been used. Such wire is expensive, but still the intrusion of noise has not be prevented.

The present invention also aims to prevent the intrusion of such electrical noise. To achieve this object, in the signal transmitting line is inserted an impedance transducer consisting of an emitter follower circuit or matching transformer to reduce an output impedance. By the insertion of this impedance transducer can be prevented the intrusion of noise into a power source line also used as a signal transmitting line. This impedance transducer has an additional advantage as it also functions as a buffer. Thus, the oscillating frequency of the main unit will be stabilized, so abnormal oscillation of each remote unit can be prevented.

DESCRIPTION OF THE INVENTION

Figure 1:
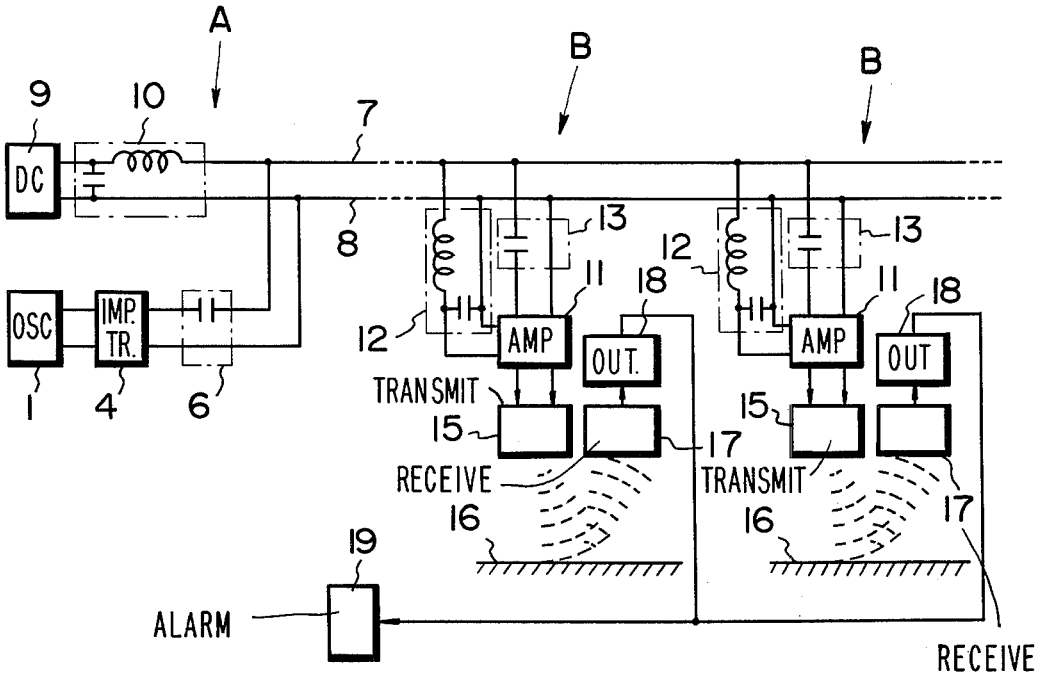
FIG. 1 is a block diagram showing an embodiment of a burglar alarm in accordance with the present invention.
Figure 2:
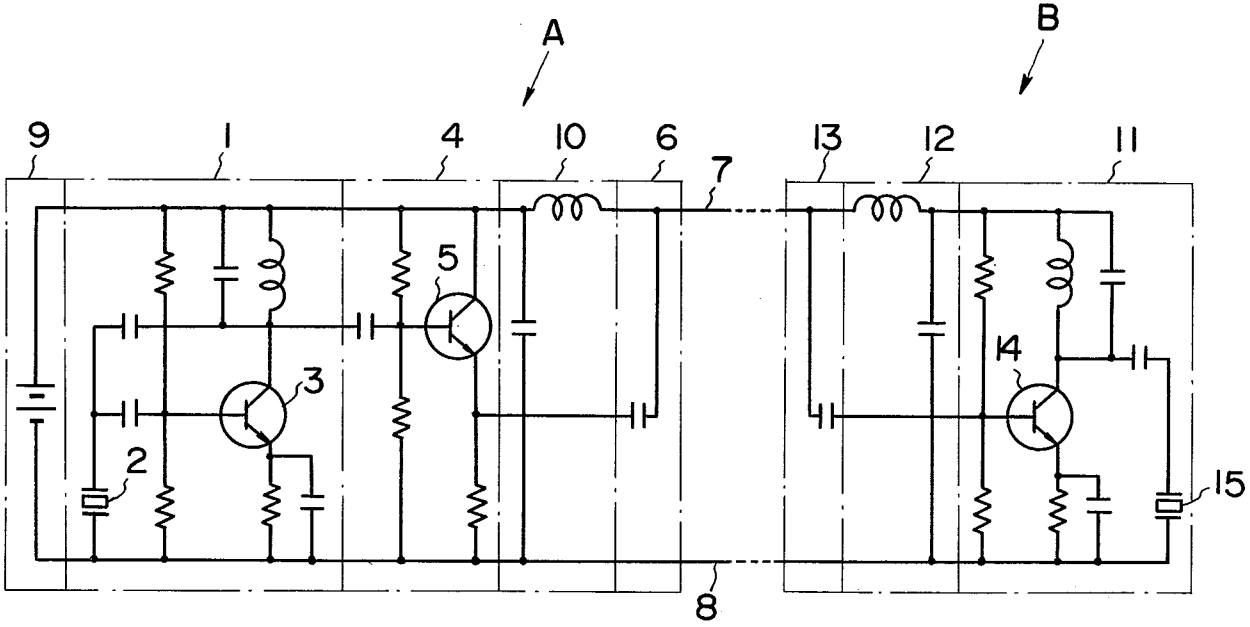
FIG. 2 is a practical wiring diagram between a main unit and each remote unit.

The outline of the present invention will be described in accordance with FIG. 1 and then the detail thereof will be described in accordance with FIG. 2.

Figure 3:
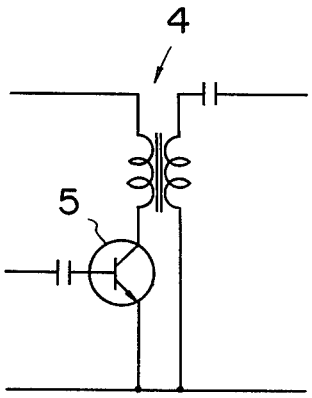
FIG. 3 is an electric wiring diagram of a modification using a matching transformer.

Reference letter A designates a main unit, wherein an oscillator 1 is a modification of a so-called pierce-type oscillating circuit consisting of a coil, resistors and capacitors in addition to a crystal resonator 2 and a transistor 3. This oscillator 1 may be replaced by an LC oscillator or other type oscillator only if the oscillating frequency is stable. To the oscillator 1 is connected an impedance transducer 4 to prevent a variation in oscillating frequency and to prevent electrical noise from intruding into the wave transmitting line, by reducing output impedance. This impedance transducer 4 in FIG. 2 consists of an emitter follower made mainly of a transistor 5, but the emitter follower may be replaced by a matching transformer as shown in FIG. 3. This impedance transducer 4 is connected to power source lines 7 and 8 via the D.C. cut-off filter 6 consisting of a capacitor. Additionally, the D.C. power source 9 of the main unit A is connected to the above-mentioned power source lines 7 and 8 via the low-pass filter 10 consisting of a coil and a capacitor. The power source lines 7 and 8 simultaneously serve as signal transmitting lines, are wired on ceilings and floors of a building, and have connected thereto in parallel a plurality of remote units B respectively placed on doors, windows, etc. The amplifier 11 of each unit B, connects to the power source lines 7 and 8 at its power source side via the low-pass filter 12 consisting of a coil and a capacitor, and at its oscillating signal side via the D.C. cutoff filter 13 consisting of a capacitor. The amplifier 11, consisting of a transistor 14 and a coil, resistor and capacitor, is connected to the ultrasonic wave transmitting transducer 15 which consists of a magnetic strain oscillator, piezo oscillator or electric strain oscillator, and generates an ultrasonic wave. This wave transmitting transducer 15 may be installed on a ceiling so as to direct ultrasonic waves toward objects 16, for instance, doors, windows, etc. and the ultrasonic wave generated therefrom is arranged to be received by a wave receiving transducer 17 when it is reflected by such objects 16. This wave receiving transducer 17 is connected to the output circuit 18 consisting of an amplifying circuit, detecting circuit, and input signal treating circuit for the prevention of malfunction, and its output terminal is connected to the alarm 19.

Now, the operation of the above discussed apparatus will be described. D.C. power from the power source 9 of the main unit A will be stabilized by the lowpass filter 10, and then supplied to each remote unit B through the power source lines 7 and 8. The D.C. power thus supplied is stabilized power by removing high-frequency input signals and high-frequency electrical noise picked up on the way, by means of the low-pass filter 12 at the D.C. power input to the amplifer 11 of the remote unit B.

On the other hand, a high-frequency signal at the oscillator 1 of the main unit A will be stabilized in its oscillating frequency by the buffering function of the impedance transducer 4 which also reduces the output impedance of the oscillator. Any residual D.C. component is removed from this oscillating signal by the D.C. cut-off filter 6 and such high frequency oscillating signal will be transmitted to the power source lines 7 and 8. Since output impedance is reduced by the impedance transducer 4, the intrusion of electrical noise during signal transmission along the power source lines 7 and 8 will be eliminated. Since the D.C. portion from the power source section 9 is cut off by the D.C. cut-off filter 13, only the stabilized high-frequency signal will be supplied to the signal input of the amplifier 11 of each unit B. In this way, all the units B will be synchronized to the oscillating frequency of the oscillator 1 of the main unit A compulsorily, and, as a result, even when more than 2 units B are located at a short distance from each other, no beating will occur between their ultrasonic wave outputs. Under this condition, when an illegal intruder may intrude into an ultrasonic wave radiating area, there will occur the ultrasonic disturbance in a wave signal received by the wave receiving transducer 17, so with an input signal due to this disturbance the alarm 19 will ring. Once this alarm 19 begins to ring, it will be self-sustained and continues to ring.

Figure 4:
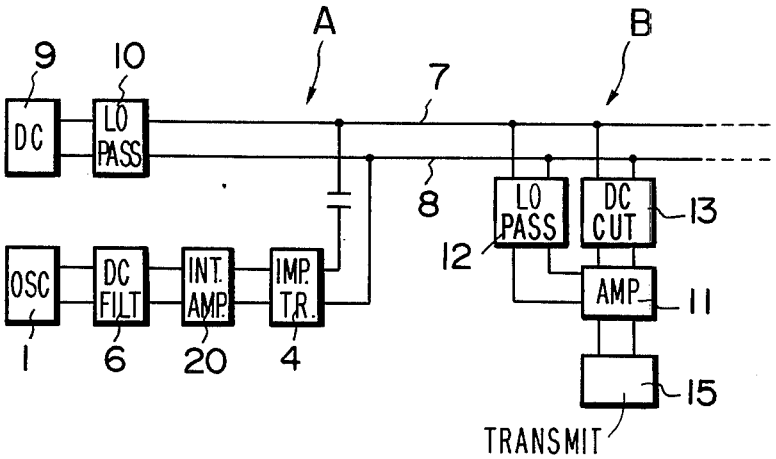
FIG. 4 is a block diagram showing another embodiment of a burglar alarm in accordance with the present invention.
Figure 5:
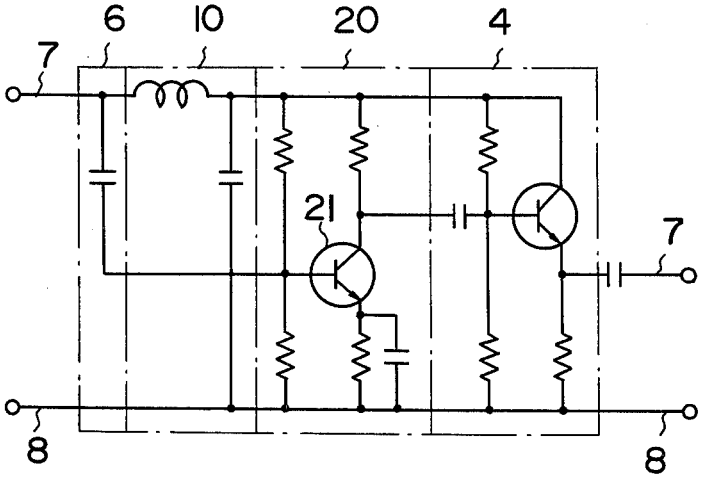
FIG. 5 is a practical electric wiring diagram of an integral part thereof.

Next, FIGS. 4 and 5 show an embodiment where when an output of the main unit A is loaded, i.e. when such output is reduced by an increase in this number of remote units B, further intermediate amplifiers 20 have been added. Such an intermediate amplifier 20 is constructed with normal circuits consisting of resistors and capacitors in addition to transistor 21, and next to such intermediate amplifier 20 is connected an impedance transducer 4 consisting of an emitter follower circuit same as mentioned above.

What I claim is:

1. In an ultrasonic burglar alarm including, a main unit having sending terminals for electrical power and for an oscillating signal, at least one remote unit to be driven by said main unit and having receiving terminals for said electrical power and said oscillating signal, said remote units each having means responsive to said electrical power and oscillating signal for emitting a reflectable ultrasonic wave and responsive to disturbance of the reflected ultrasonic wave for producing an input signal, and an alarm actuable by said input signal, and power source lines connecting the electrical power receiving terminals of each said remote unit to the electrical power sending terminals of said main unit, the improvement comprised in that:

the same said power source lines also connect the oscillating signal receiving terminals of each said remote unit to the oscillating signal sending terminals of said main unit for simultaneously over the same said power source lines applying said electrical power and said oscillating signal from said main unit to said remote units, and including low pass filters inserted between said power source line and each of the electrical power terminals of said main unit and remote units, and DC cut-off filters inserted between said power source lines and each of said oscillating signal terminals of said main unit and remote units.

2. The ultrasonic burglar alarm of claim 1 in which said main unit includes means for reducing the output impedance of said main unit and comprising an impedance transducer inserted ahead of and for supplying said oscillating signal to said oscillating signal sending terminal of said main unit.

3. The ultrasonic burglar alarm of claim 2 in which said impedance transducer comprises an emitter follower circuit.

4. The ultrasonic burglar alarm of claim 2 in which said impedance transducer comprises a matching transformer.

5. The ultrasonic burglar alarm of claim 1 including a plurality of remote units, and to avoid loading of the oscillating signal output of said main unit, an intermediate amplifier and an impedance reducing emitter follower driven thereby interposed serially between said oscillating signal sending terminals of said main unit and said power source lines.

6. An ultrasonic burglar alarm comprising:

a transmission line pair;

a DC power source;

an oscillator of stable oscillating frequency driving an impedance reducing emitter follower circuit and supplied operating potential by connection across a DC source;

means including an LC filter connecting said DC source across said transmission line pair for applying said DC source potential across said transmission line pair but blocking application of spurious non-DC voltages to said transmission line pair;

means including a capacitor connecting the output of said emitter follower to said transmission line pair at a location beyond said LC filter for applying said oscillating frequency free of DC bias to said transmission line pair;

means for producing an ultrasonic wave and amplifier means connected for driving said ultrasonic wave producing means and located remotely along said transmission line pair from said location;

means including a further LC filter connected across said transmission line pair at said amplifier means for supplying steady DC operating potential thereto while blocking potential transients;

means including a further capacitor connecting said transmission line pair to the signal input of said amplifier means for driving said amplifier means, and hence said ultrasonic wave producing means, with said oscillating signal, without subjecting said amplifier means signal input to said DC source potential;

alarm means responsive to disturbance of said ultrasonic wave for producing an alarm.

* * * * *